US010710138B2

(12) United States Patent
Makabe

(10) Patent No.: US 10,710,138 B2
(45) Date of Patent: Jul. 14, 2020

(54) DIE CUSHION DEVICE AND METHOD OF CONTROLLING THE DIE CUSHION DEVICE

(71) Applicant: AIDA ENGINEERING, LTD., Kanagawa (JP)

(72) Inventor: Junji Makabe, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 580 days.

(21) Appl. No.: 15/384,478

(22) Filed: Dec. 20, 2016

(65) Prior Publication Data

US 2017/0182539 A1 Jun. 29, 2017

(30) Foreign Application Priority Data

Dec. 24, 2015 (JP) ..... 2015-252167

(51) Int. Cl.
*B21D 24/02* (2006.01)
*B21D 24/14* (2006.01)

(52) U.S. Cl.
CPC ..... *B21D 24/02* (2013.01); *B21D 24/14* (2013.01)

(58) Field of Classification Search
CPC ..... B21D 24/00; B21D 24/02; B21D 24/08; B21D 24/10; B21D 24/14
See application file for complete search history.

(56) References Cited

U.S. PATENT DOCUMENTS

| | | | |
|---|---|---|---|
| 2006/0090656 | A1 | 5/2006 | Iwashita et al. |
| 2009/0071218 | A1 | 3/2009 | Kohno et al. |
| 2009/0078016 | A1 | 3/2009 | Suzuki |
| 2009/0158810 | A1 | 6/2009 | Kohno et al. |
| 2011/0265544 | A1 | 11/2011 | Micklisch et al. |

FOREIGN PATENT DOCUMENTS

| | | | |
|---|---|---|---|
| EP | 2384834 | A2 | 11/2011 |
| JP | 64-057927 | A | 3/1989 |
| JP | H10-192997 | A | 7/1998 |
| JP | 2006-130524 | A | 5/2006 |
| JP | 2006-130533 | A | 5/2006 |
| JP | 2006-142312 | A | 6/2006 |
| JP | 2006-255743 | A | 9/2006 |
| JP | 2006-315074 | A | 11/2006 |
| JP | 2010-240673 | A | 10/2010 |

OTHER PUBLICATIONS

Extended European Search Report dated May 29, 2017, issued in European Patent Application No. 16205284.9.
Official Communication issued in corresponding European Patent Application No. 16205284.9 dated Nov. 6, 2019.

*Primary Examiner* — Teresa M Ekiert
(74) *Attorney, Agent, or Firm* — McDermott Will & Emery LLP

(57) ABSTRACT

A die cushion device includes a hydraulic cylinder that supports a cushion pad and generates die cushion force when the slide of the press machine descends, a first hydraulic circuit that is connected to a cap side hydraulic chamber of the hydraulic cylinder, and a second hydraulic circuit that is connected to a rod side hydraulic chamber. Before die cushion force control starts, the second hydraulic circuit of the die cushion device causes hydraulic oil in the rod side hydraulic chamber to be prevented from flowing out, and the first hydraulic circuit of the die cushion device causes the cap side hydraulic chamber to be pressurized.

15 Claims, 8 Drawing Sheets

DIE CUSHION DEVICE AND METHOD OF CONTROLLING THE DIE CUSHION DEVICE

CROSS-REFERENCE TO RELATED APPLICATIONS

This application claims priority to Japanese Patent Application No. 2015-252167 filed Dec. 24, 2015, The entire contents of which are hereby incorporated herein by reference in entirety.

BACKGROUND OF THE INVENTION

Field of the Invention

The present invention relates to a die cushion device and a method of controlling the die cushion device, and more particularly to a technique of improving responsivity of action of cushion force.

Description of the Related Art

In a press machine including a die cushion device, there has been known a die cushion device that controls hydraulic pressure (die cushion force) in a cap side hydraulic chamber of a hydraulic cylinder supporting a cushion pad by using a servo motor for driving a hydraulic pump connected to cap side hydraulic chamber, or a servo valve (refer to Japanese Patent Application Laid-Open No. 2006-315074 (Patent Literature 1) and Japanese Patent Application Laid-Open No. 2006-142312 (Patent Literature 2)).

Japanese Patent Application Laid-Open No. 2006-130524 (Patent Literature 3) describes a die cushion mechanism provided with a control device that causes required die cushion force to be properly generated with high responsivity by using slide speed when controlling force of a servo motor for driving the die cushion mechanism.

Japanese Patent Application Laid-Open No. 2006-130533 (Patent Literature 4) describes a control device of a servo motor, the control device achieving high responsivity in terms of control by using command correction means for controlling pressure when force is applied to a driven body to be driven by the servo motor.

Japanese Patent Application Laid-Open No. 2006-255743 (Patent Literature 5) describes a die cushion control device that achieves high responsivity in terms of control by controlling a command to increase pressure, thereby allowing high cushion pressure, required to hold a work, to be promptly generated, and that reduces fluctuations in cushion pressure to enable a product to be favorably formed.

Japanese Patent Application Laid-Open No. 10-192997 (Patent Literature 6) describes a method of controlling die cushion, the method achieving high responsivity in terms of control by switching between position control and pressure control by position detection of a cushion cylinder, and by the pressure control by a proportion (P)/integration (I) control command and a bias signal.

Meanwhile, there is typically conceived a method of controlling die cushion force in which a cushion pad is put on standby at a position above a die cushion standby position by a predetermined amount, and die cushion force is increased to a setting value in a period where the cushion pad descends to the die cushion standby after a slide collides with the cushion pad (or within response delay time of the die cushion force).

SUMMARY OF THE INVENTION

The die cushion device described in each of Patent Literatures 1 and 2 causes a problem in that response delay time occurs by the time die cushion force increases to a preset value after a slide collides with a cushion pad (an upper die mounted to the slide collides with the cushion pad supported by a hydraulic cylinder through a material, a blank holder, and a cushion pin) while the slide of a press machine descends, and that the slide descends below an initial position (a die cushion standby position set for each die) of the cushion pad with which the slide collides, while the response delay time elapses.

In addition, while the die cushion device described in each of Patent Literatures 1 and 2 generates die cushion force by controlling hydraulic pressure in a cap side hydraulic chamber of the hydraulic cylinder, this mechanism does not enable the pressure in the cap side hydraulic chamber of the hydraulic cylinder to be controlled before the slide and the cushion pad collide with each other.

While the device described in each of Patent Literatures 3 to 6 generates die cushion force with high responsivity, the pressure in the cap side hydraulic chamber of the hydraulic cylinder cannot be controlled before the slide and the cushion pad collide with each other, as with the die cushion device described in each of Patent Literatures 1 and 2.

Meanwhile, in the case of a technique in which a cushion pad is put on standby at a position above a die cushion standby position by a predetermined amount, and die cushion force is increased to a setting value when the cushion pad descends to the die cushion standby position, the cushion pad needs to be raised above the die cushion standby position by the predetermined amount, whereby die structure (e.g. an upper limit position of a die stroke) is greatly restricted to have little practicability.

The present invention is made in light of the above-mentioned circumstances, and an object thereof is to provide a die cushion device and a method of controlling the die cushion device, capable of increasing responsivity of action of die cushion force, and of generating desired die cushion force particularly when a cushion pad is positioned at a die cushion standby position, without greatly restricting die structure.

To achieve the object above, a die cushion device according to an aspect of the present invention includes a fluid-pressure cylinder that supports a cushion pad and generates die cushion force while a slide of a press machine descends, a fluid-pressure circuit that enables operation fluid to be prevented from flowing out from a rod side fluid-pressure chamber of the fluid-pressure cylinder, or that enables the operation fluid to flow into the rod side fluid-pressure chamber, and a pressurization controller that causes the fluid-pressure circuit to prevent the operation fluid from flowing out from the rod side fluid-pressure chamber of the fluid-pressure cylinder before die cushion force control starts, and causes pressure fluid to be supplied to a cap side fluid-pressure chamber of the fluid-pressure cylinder while the operation fluid is prevented from flowing out to pressurize the cap side fluid-pressure chamber.

According to the aspect of the present invention, since the fluid-pressure circuit is controlled to enable operation fluid to be prevented from flowing out from the rod side fluid-pressure chamber of the fluid-pressure cylinder, the cap side fluid-pressure chamber can be pressurized by preventing the operation fluid from flowing out and supplying pressure fluid to the cap side fluid-pressure chamber of the fluid-pressure cylinder, even before die cushion force is controlled. Then, increasing pressure in the cap side fluid-pressure chamber of the fluid-pressure cylinder before die cushion force control starts enables increase in responsivity of action of the die cushion force. While pressurizing the cap side fluid-pressure chamber of the fluid-pressure cylinder also pressurizes the rod side fluid-pressure chamber of the fluid-pressure cylinder from which the operation fluid is prevented from flowing out, an amount of rise of the cushion pad corresponding to an amount of volume compression due to pressurization in the rod side fluid-pressure chamber is little, whereby there is no problem in that die structure is greatly restricted.

In a die cushion device according to another aspect of the present invention, the fluid-pressure circuit includes a check valve that prevents operation fluid from flowing out from the rod side fluid-pressure chamber of the fluid-pressure cylinder, and a depressure valve that is provided parallel to the check valve, and the pressurization controller causes the depressure valve to close, before the die cushion force control starts, to prevent the operation fluid from flowing out from the rod side fluid-pressure chamber of the fluid-pressure cylinder.

While the check valve prevents the operation fluid from flowing out from the rod side fluid-pressure chamber of the fluid-pressure cylinder, it enables the operation fluid to flow into the rod side fluid-pressure chamber. As a result, when the slide collides with the cushion pad to cause the cushion pad (a piston rod of the fluid-pressure cylinder descends) to start descending, the operation fluid is allowed to immediately flow into the rod side fluid-pressure chamber.

In a die cushion device according to yet another aspect of the present invention, the fluid-pressure circuit includes a pilot drive type check valve that prevents operation fluid from flowing out from the rod side fluid-pressure chamber of the fluid-pressure cylinder, and the pressurization controller controls pilot pressure to cause the pilot drive type check valve to close, before the die cushion force control starts, to prevent the operation fluid from flowing out from the rod side fluid-pressure chamber of the fluid-pressure cylinder.

In a die cushion device according to yet another aspect of the present invention, it is preferable that there is further provided a die cushion position controller configured to allow operation fluid to be supplied to the cap side fluid-pressure chamber of the fluid-pressure cylinder to raise the cushion pad to a predetermined die cushion standby position after the die cushion force control is finished, and that when the cushion pad is moved to the die cushion standby position by the die cushion position controller, the pressurization controller allows pressure fluid to be supplied to the cap side fluid-pressure chamber of the fluid-pressure cylinder while operation fluid is prevented from flowing out from the rod side fluid-pressure chamber of the fluid-pressure cylinder by controlling the fluid-pressure circuit.

In a period where the die cushion position controller allows the cushion pad to be moved to the die cushion standby position (position control period), since the cushion pad needs to be raised (operation fluid needs to be supplied to the cap side fluid-pressure chamber of the fluid-pressure cylinder), operation fluid is allowed to flow out from the rod side fluid-pressure chamber of the fluid-pressure cylinder, and when the cushion pad is moved to the die cushion standby position, operation fluid is prevented from flowing out from the rod side fluid-pressure chamber of the fluid-pressure cylinder to enable pressure in the cap side fluid-pressure chamber of the fluid-pressure cylinder to be controlled (switching to pressure control).

In a die cushion device according to yet another aspect of the present invention, it is preferable that pressure in the cap side fluid-pressure chamber of the fluid-pressure cylinder pressurized by control of the pressurization controller is equal to pressure at which the fluid-pressure cylinder generates a preset die cushion force.

That is, when the pressurization controller causes the cap side fluid-pressure chamber of the fluid-pressure cylinder to be pressurized to the pressure above, the rod side fluid-pressure chamber of the fluid-pressure cylinder from which operation fluid is prevented from flowing out is also pressurized, and then the cushion pad slightly rises from the die cushion standby position in accordance with an amount of volume compression caused by pressurizing the rod side fluid-pressure chamber. After that, the slide descends and collides with the cushion pad to cause the cushion pad to descend together with the slide, and then pressure in the rod side fluid-pressure chamber of the fluid-pressure cylinder is reduced to increase die cushion force. When the cushion pad reaches the die cushion standby position, or when the cushion pad descends by an amount of rise caused by pressurization controlled by the pressurization controller to cause pressure in the rod side fluid-pressure chamber of the fluid-pressure cylinder to decrease to pressure in a state where the cushion pad is at the die cushion standby position, the fluid-pressure cylinder generates the preset die cushion force.

In a die cushion device according to yet another aspect of the present invention, it is preferable that pressure in the cap side fluid-pressure chamber of the fluid-pressure cylinder pressurized by control of the pressurization controller is more than pressure at which the cushion pad is moved to the die cushion standby position as well as less than pressure at which the fluid-pressure cylinder generates the preset cushion force.

This enables an amount of rise of the cushion pad to be less than an amount of rise of the cushion pad in the case of setting pressure in the cap side fluid-pressure chamber of the fluid-pressure cylinder to pressure at which the preset die cushion force is generated. In addition, increasing pressure in the fluid-pressure cylinder to the pressure at which the fluid-pressure cylinder generates the preset die cushion force, by the time the slide descends to a cushion pad standby position after colliding with the cushion pad, enables the preset die cushion force to be generated at the cushion pad standby position.

In a die cushion device according to yet another aspect of the present invention, it is preferable to provide a pressure detector that detects pressure in the cap side fluid-pressure chamber of the fluid-pressure cylinder, a fluid-pressure pump/motor with a discharge port connected to the cap side fluid-pressure chamber of the fluid-pressure cylinder through piping, an electric motor connected to a rotating shaft of the fluid-pressure pump/motor, a die cushion pressure command device that outputs a preset die cushion pressure command, and a die cushion force controller that controls torque of the electric motor on the basis of the die cushion pressure command and pressure detected by the pressure detector to cause die cushion pressure to be a pressure corresponding to the die cushion pressure command.

In a die cushion device according to yet another aspect of the present invention, it is preferable that before die cushion force control starts, the pressurization controller controls torque of the electric motor to control fluid-pressure to be supplied to the cap side fluid-pressure chamber of the fluid-pressure cylinder.

In a die cushion device according to yet another aspect of the present invention, it is preferable to provide a proportion flow control valve provided in piping connected to the cap side fluid-pressure chamber of the fluid-pressure cylinder, and a die cushion force controller that controls opening of the proportion flow control valve to cause a flow rate of operation fluid discharged from the cap side fluid-pressure chamber of the fluid-pressure cylinder to be controlled to control the pressure in the cap side fluid-pressure chamber of the fluid-pressure cylinder.

The invention according to yet another aspect is a method of controlling a die cushion device that includes a fluid-pressure cylinder that supports a cushion pad and generates die cushion force while a slide of a press machine descends, and a fluid-pressure circuit that enables operation fluid to be prevented from flowing out from a rod side fluid-pressure chamber of the fluid-pressure cylinder, or that enables the operation fluid to flow into the rod side fluid-pressure chamber, and the method includes the steps of: preventing operation fluid from flowing out from the rod side fluid-pressure chamber of the fluid-pressure cylinder by controlling the fluid-pressure circuit before the die cushion force control starts; and pressurizing the cap side fluid-pressure chamber of the fluid-pressure cylinder by supplying pressure fluid to the cap side fluid-pressure chamber of the fluid-pressure cylinder while the operation fluid is prevented from flowing out.

In a method of controlling the die cushion device, according to yet another aspect of the present invention, it is preferable that there is provided the step of supplying operation fluid to the cap side fluid-pressure chamber of the fluid-pressure cylinder after the die cushion force control is finished to cause the cushion pad to rise to a predetermined die cushion standby position, and that in the step of preventing the operation fluid from flowing out, the fluid-pressure circuit is controlled to prevent the operation fluid from flowing out from the rod side fluid-pressure chamber of the fluid-pressure cylinder when the cushion pad is moved to the die cushion standby position. This enables control of pressure in the cap side fluid-pressure chamber of the fluid-pressure cylinder after the cushion pad is moved to the die cushion standby position.

In a method of controlling the die cushion device according to yet another aspect of the present invention, it is preferable that pressure in the cap side fluid-pressure chamber of the fluid-pressure cylinder pressurized in the step of pressurization is equal to pressure at which the fluid-pressure cylinder generates a preset die cushion force.

In a method of controlling the die cushion device according to yet another aspect of the present invention, it is preferable that pressure in the cap side fluid-pressure chamber of the fluid-pressure cylinder pressurized in the step of pressurization is more than pressure at which the cushion pad is moved to the die cushion standby position as well as less than pressure at which the fluid-pressure cylinder generates the preset cushion force.

In a method of controlling the die cushion device according to yet another aspect of the present invention, it is preferable that the die cushion device further includes a die cushion position controller configured to allow operation fluid to be supplied to the cap side fluid-pressure chamber of the fluid-pressure cylinder to raise the cushion pad to a predetermined die cushion standby position after the die cushion force control is finished, and preferable that the method includes the step of controlling the fluid-pressure circuit during press forming performed by lowering the slide and during position control of the cushion pad to enable operation fluid to flow into the rod side fluid-pressure chamber of the fluid-pressure cylinder during the press forming as well as enable the operation fluid to flow out from the rod side fluid-pressure chamber of the fluid-pressure cylinder during the position control.

According to the present invention, it is possible to control pressure in a cap side (die cushion pressure generating side) fluid-pressure chamber of a fluid-pressure cylinder that generates die cushion force, before the die cushion force control starts. This enables increase in responsivity of action of the die cushion force, and enables a cushion pad not to be greatly raised from a normal die cushion standby position.

DETAILED DESCRIPTION OF THE EMBODIMENTS

With reference to accompanying drawings, preferable embodiments of a die cushion device and a method of controlling the die cushion device, according to the present invention, will be described in detail.

First Embodiment of Die Cushion Device

Figure 1:
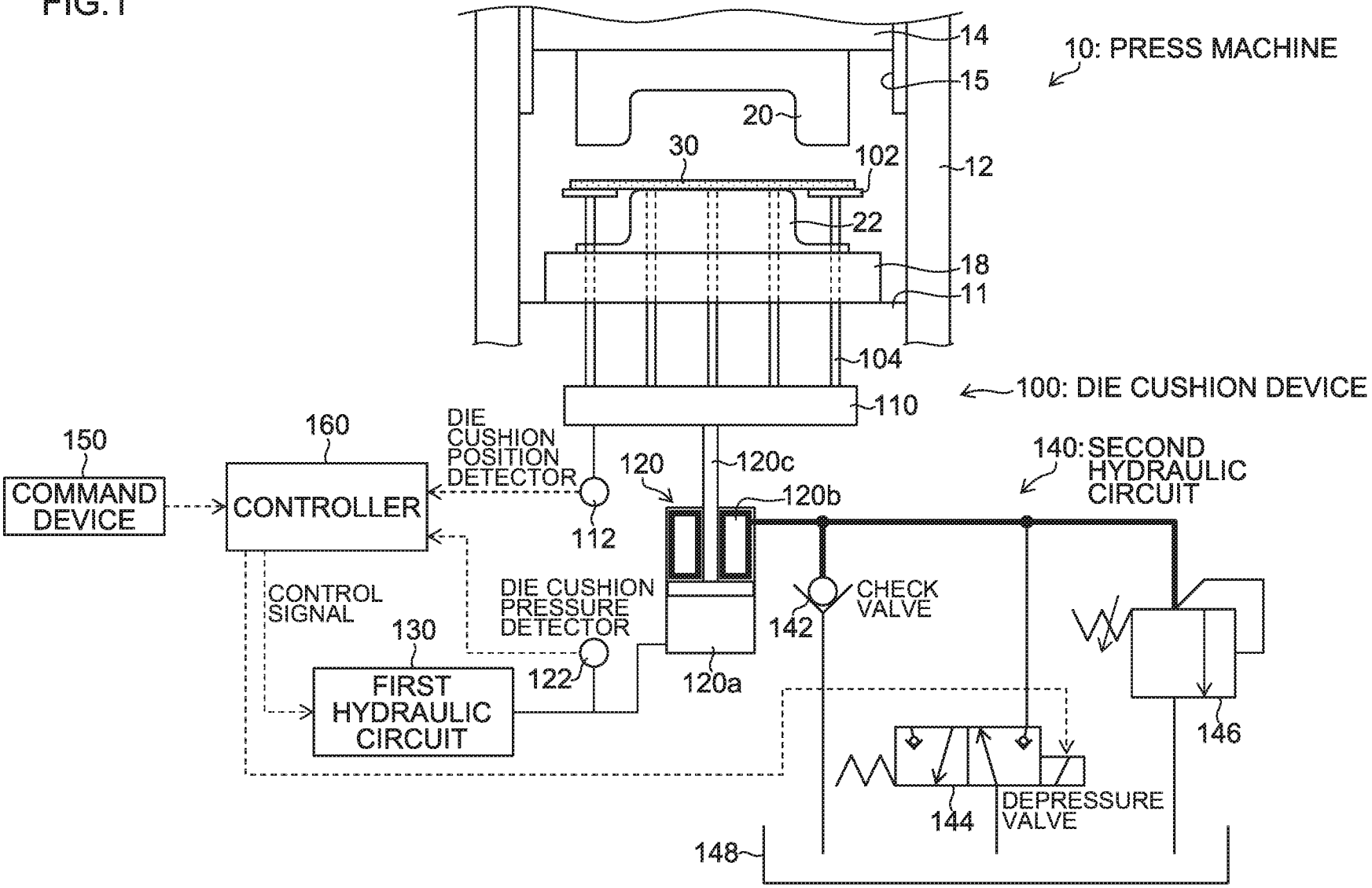
FIG. 1 is a structural view illustrating a first embodiment of a die cushion device according to the present invention.

FIG. 1 is a structural view illustrating a first embodiment of the die cushion device according to the present invention.

In FIG. 1, a press machine 10 using a die cushion device 100 includes a frame composed of a bed 11, a column 12, and a crown (not illustrated), and a slide 14 that is guided in a vertically movable manner by a guide section 15 provided in the column 12. The slide 14 receives driving force transmitted from a slide driving unit (not illustrated), and is moved in a vertical direction in FIG. 1.

An upper die 20 is mounted to the slide 14, and a lower die 22 is mounted on a bolster 18 of the bed 11.

A blank holder (blank holding plate) 102 is disposed in a space between the upper die 20 and the lower die 22, and has a lower side supported by a cushion pad 110 through a plurality of cushion pins 104 and an upper side on which a material 30 is set (brought into contact with).

The press machine 10 lowers the slide 14 to press-form the material 30 between the upper die 20 and the lower die 22. The die cushion device 100 presses the periphery of the material 30 to be press-formed from below.

(Structure of Die Cushion Device)

The die cushion device 100 includes the blank holder 102, the cushion pad 110 that supports the blank holder 102 through the plurality of cushion pins 104, a hydraulic cylinder (fluid-pressure cylinder) 120 that supports the cushion pad 110 to apply die cushion force to the cushion pad 110, a first hydraulic circuit 130 connected to a cap side hydraulic chamber (cap side fluid-pressure chamber) 120*a* of the hydraulic cylinder 120, a second hydraulic circuit 140 connected to a rod side hydraulic chamber (rod side fluid-pressure chamber) 120*b* of the hydraulic cylinder 120, a command device 150, and a controller 160.

The die cushion device 100 has a die cushion force control function of controlling die cushion force generated in the cushion pad 110, and a die cushion position control function of controlling a position of the cushion pad 110. The die cushion force control is mainly performed in a die cushion force generating period (during press forming) by the time the slide 14 reaches the bottom dead center after the slide 14 collides with the cushion pad 110 (the upper die 20 mounded to the slide 14 collides with the cushion pad 110 supported by the hydraulic cylinder 120, through the material 30, the blank holder 102, and the cushion pin 104) when the slide 14 of the press machine 10 descends, and the die cushion position control is performed in a period by the time the cushion pad 110 is raised to a standby position (die cushion standby position) set corresponding to a die from a position corresponding to the bottom dead center.

The hydraulic cylinder 120 and the first hydraulic circuit 130 serve as not only a die cushion force generator that applies die cushion force to the cushion pad 110, but also a cushion pad lifter that moves up and down the cushion pad 110.

In FIG. 1, reference numeral 112 designates a die cushion position detector that detects a position in a stretching direction of a piston rod 120*c* of the hydraulic cylinder 120 as a position in a lifting direction of the cushion pad 110, and reference numeral 122 designates a die cushion pressure detector that detects pressure in the cap side hydraulic chamber (die cushion pressure generating side hydraulic chamber) 120*a* of the hydraulic cylinder 120.

The command device 150 includes a die cushion force (pressure) command device and a die cushion position command device. The command device 150 outputs a command value indicating a die cushion force that is a value to be controlled, or die cushion pressure corresponding to the die cushion force during the die cushion force control, and outputs a command value indicating a die cushion position that is a value to be controlled during the die cushion position control.

The controller 160 includes a die cushion force (pressure) controller and a die cushion position controller. The controller 160 outputs a control signal to the first hydraulic circuit 130 on the basis of a command value (command value indicating a die cushion pressure) received from the command device 150 and pressure detected by the die cushion pressure detector 122 during the die cushion force control to cause pressure in the cap side hydraulic chamber 120*a* of the hydraulic cylinder 120 to be the command value. Meanwhile, the controller 160 outputs a control signal to the first hydraulic circuit 130 on the basis of a command value (command value indicating a die cushion position) received from the command device 150 and die cushion position detected by the die cushion position detector 112 during the die cushion position control to cause position of the cushion pad 110 to be the command value.

The first hydraulic circuit 130, on the basis of a command signal received from the controller 160, controls hydraulic pressure to be released from the cap side hydraulic chamber 120*a* of the hydraulic cylinder 120 to apply desired die cushion force to the cushion pad 110 during the die cushion force control, and controls an amount of oil flowing into the cap side hydraulic chamber 120*a* of the hydraulic cylinder 120 to raise the cushion pad 110 to the die cushion standby position during the die cushion position control.

The first hydraulic circuit 130 and the controller 160 supply pressure oil (pressure fluid) to the cap side hydraulic chamber 120*a* of the hydraulic cylinder 120 before the die cushion force control starts, and thus serve as a pressurization controller that pressurizes the cap side hydraulic chamber 120*a*, and its detail will be described later.

The second hydraulic circuit 140 (fluid-pressure circuit) prevents hydraulic oil (operation fluid) from flowing out from the rod side hydraulic chamber 120*b* of the hydraulic cylinder 120, or enables hydraulic oil to flow into the rod side hydraulic chamber 120*b*. The second hydraulic circuit 140 includes a check valve 142 that prevents hydraulic oil from flowing out from the rod side hydraulic chamber 120*b* of the hydraulic cylinder 120, a depressure valve 144 and a relief valve 146 provided parallel to the check valve 142, and a tank 148.

The depressure valve 144 is controlled for its opening and closing by the controller 160, and prevents hydraulic oil from flowing out from the rod side hydraulic chamber 120*b* of the hydraulic cylinder 120, or enables the hydraulic oil to flow into the rod side hydraulic chamber 120*b* of the hydraulic cylinder 120.

The relief valve 146 is used for preventing breakage of a hydraulic device by causing pressure oil to flow out when abnormal pressure occurs in the rod side hydraulic chamber 120*b* of the hydraulic cylinder 120 (when abnormal pressure suddenly occurs because pressure control is impossible).

[Method of Controlling Die Cushion Device]

Next, a method of controlling the die cushion device 100 configured as above will be described.

Figure 2:
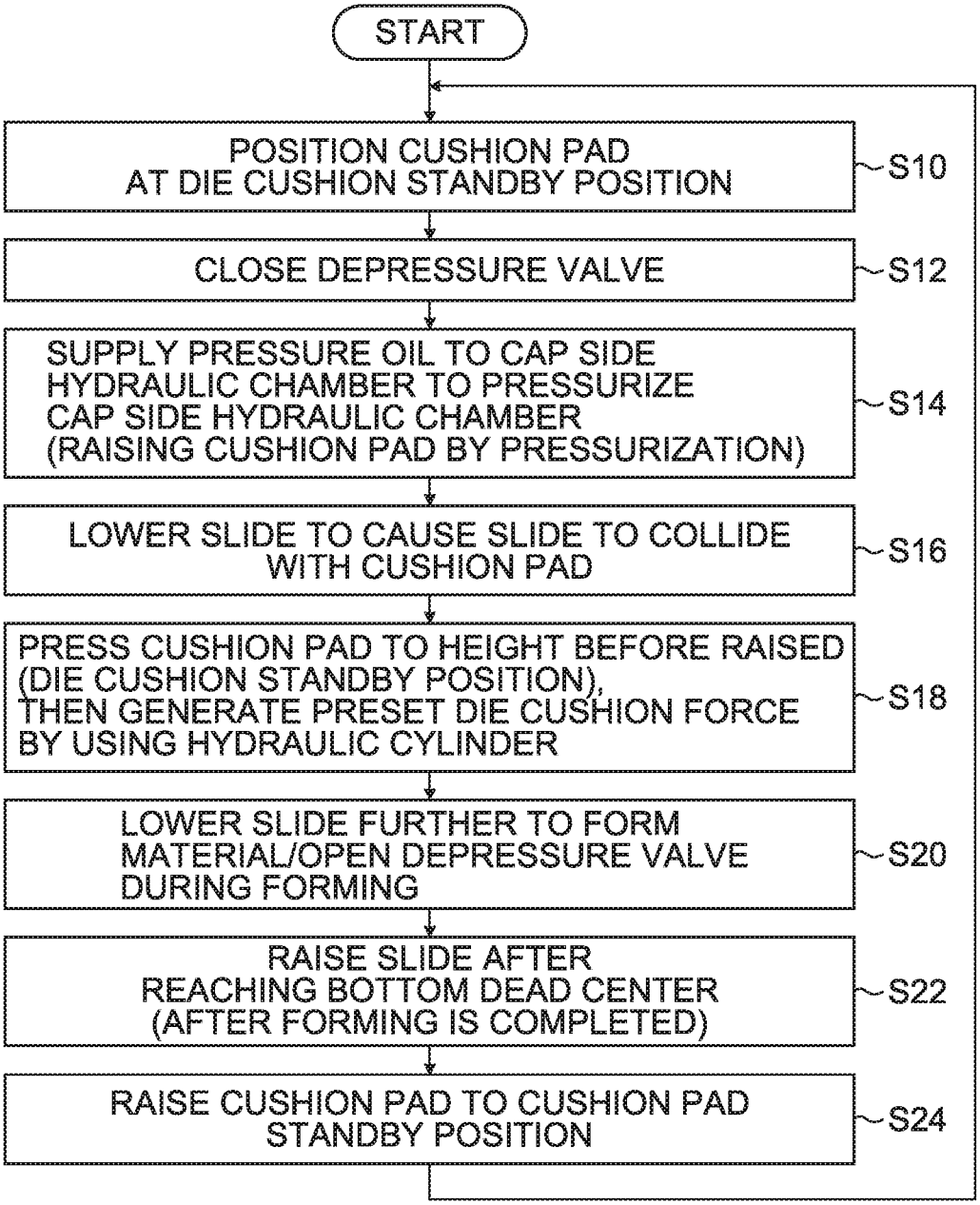
FIG. 2 is a flow chart illustrating a method of controlling a die cushion device, according to the present invention, and particularly a method of controlling the die cushion device of the first embodiment.

FIG. 2 is a flow chart illustrating a method of controlling a die cushion device, according to the present invention, and particularly a method of controlling the die cushion device 100 of the first embodiment.

When the slide 14 of the press machine 10 reaches the bottom dead center (press forming is finished) and rises, the die cushion device 100 then transitions to a die cushion position control state from a die cushion force control state, and moves (raises) the cushion pad 110 to a preset die cushion standby position.

Step S10 illustrated in FIG. 2 shows the die cushion position control state where the cushion pad 110 is put on standby (positioned) at the die cushion standby position.

When the cushion pad 110 is positioned at the die cushion standby position, the die cushion device 100 transitions to the die cushion force control state from the die cushion position control state. Then the controller 160 serving as a pressurization controller first causes the depressure valve 144 to close (step S12). This prevents hydraulic oil from flowing out from the rod side hydraulic chamber 120*b* of the hydraulic cylinder 120.

Subsequently, the controller 160 controls the first hydraulic circuit 130 to cause pressure oil to be supplied to the cap side hydraulic chamber 120*a* of the hydraulic cylinder 120 to pressurize the cap side hydraulic chamber 120*a* until pressure therein reaches a preset pressure (step S14). Since hydraulic oil is prevented from flowing out from the rod side hydraulic chamber 120*b* of the hydraulic cylinder 120, the cap side hydraulic chamber 120*a* of the hydraulic cylinder 120 can be pressurized until pressure therein reaches the preset pressure. The preset pressure corresponds to pressure applied to the cap side hydraulic chamber 120*a* when the hydraulic cylinder 120 generates a preset die cushion force, in the present example.

In addition, if the cap side hydraulic chamber 120*a* of the hydraulic cylinder 120 is pressurized until pressure therein reaches the preset pressure, the rod side hydraulic chamber 120*b* of the hydraulic cylinder 120 from which hydraulic oil is prevented from flowing out is also pressurized. While the cushion pad 110 (piston rod 120*c*) then rises in accordance with an amount of volume compression due to this pressurization in the rod side hydraulic chamber 120*b*, an amount of rise of the cushion pad 110 in accordance with the amount of volume compression is little, whereby the cushion pad 110 does not greatly rise from a normal die cushion standby position.

After that, the slide 14 of the press machine 10 descends to a position slightly above the cushion pad standby position to collide with the cushion pad 110 (step S16).

While the slide 14 collides with the cushion pad 110 to cause the cushion pad 110 to descends together with the slide 14, the controller 160 controls pressure in the cap side hydraulic chamber 120*a* of the hydraulic cylinder 120 through the first hydraulic circuit 130 to cause the pressure to be maintained at the preset pressure. Meanwhile, when the cushion pad 110 (piston rod 120*c*) descends after the slide 14 and the cushion pad 110 collides with each other, pressure (pressure increased previously) in the rod side hydraulic chamber 120*b* of the hydraulic cylinder 120 is reduced. As a result, the hydraulic cylinder 120 generates die cushion force corresponding to pressure difference between the cap side hydraulic chamber 120*a* and the rod side hydraulic chamber 120*b*. When the cushion pad 110 is lowered to the height of a position before rising (die cushion standby position), or when pressure in the rod side hydraulic chamber 120*b* is reduced to pressure in a state where the cushion pad 110 is at the die cushion standby position (pressure in the tank 148 in the preset example), the hydraulic cylinder 120 generates the preset die cushion force (step S18).

This enables the preset die cushion force to be applied to the cushion pad 110 from the time when the cushion pad 110 is positioned at the die cushion standby position (the time when press forming starts), thereby enabling increase in responsivity of action of die cushion force.

When the slide 14 further descends, a material is formed by the upper die 20 and the lower die 22 while die cushion force is applied to the material. During forming the material, the controller 160 causes the depressure valve 144 to open (step S20). When the cushion pad 110 descends, hydraulic oil can flow into the rod side hydraulic chamber 120*b* of the hydraulic cylinder 120 also through the check valve 142. Thus, the depressure valve 144 may be controlled to open by the time position control (rising) of the cushion pad 110 starts.

When the slide 14 reaches the bottom dead center, forming is completed, and then the slide 14 starts rising (step S22). When the slide 14 starts rising, the die cushion device 100 transitions to the die cushion position control state from the die cushion force control state, and raises the cushion pad 110 to the cushion pad standby position (step S24). That is, during the die cushion position control, the controller 160 outputs a control signal for controlling position of the cushion pad 110 to the first hydraulic circuit 130 on the basis of a command value indicating a die cushion position, received from the command device 150, and a die cushion position detected by the die cushion position detector 112. Then, the first hydraulic circuit 130 causes hydraulic oil to be supplied to the cap side hydraulic chamber 120*a* of the hydraulic cylinder 120 in response to the control signal received from the controller 160, thereby raising the cushion pad 110 to the cushion pad standby position. At this time, the depressure valve 144 opens at step S20, and thus hydraulic oil in the rod side hydraulic chamber 120*b* is allowed to flow into the tank 148 when the cushion pad 110 (piston rod 120*c*) rises.

Then, the processes from step S10 to step S24 above are performed in one cycle period of the press machine 10.

(Action of Die Cushion Device)

Subsequently, action of the die cushion device 100 will be described.

Figure 3:
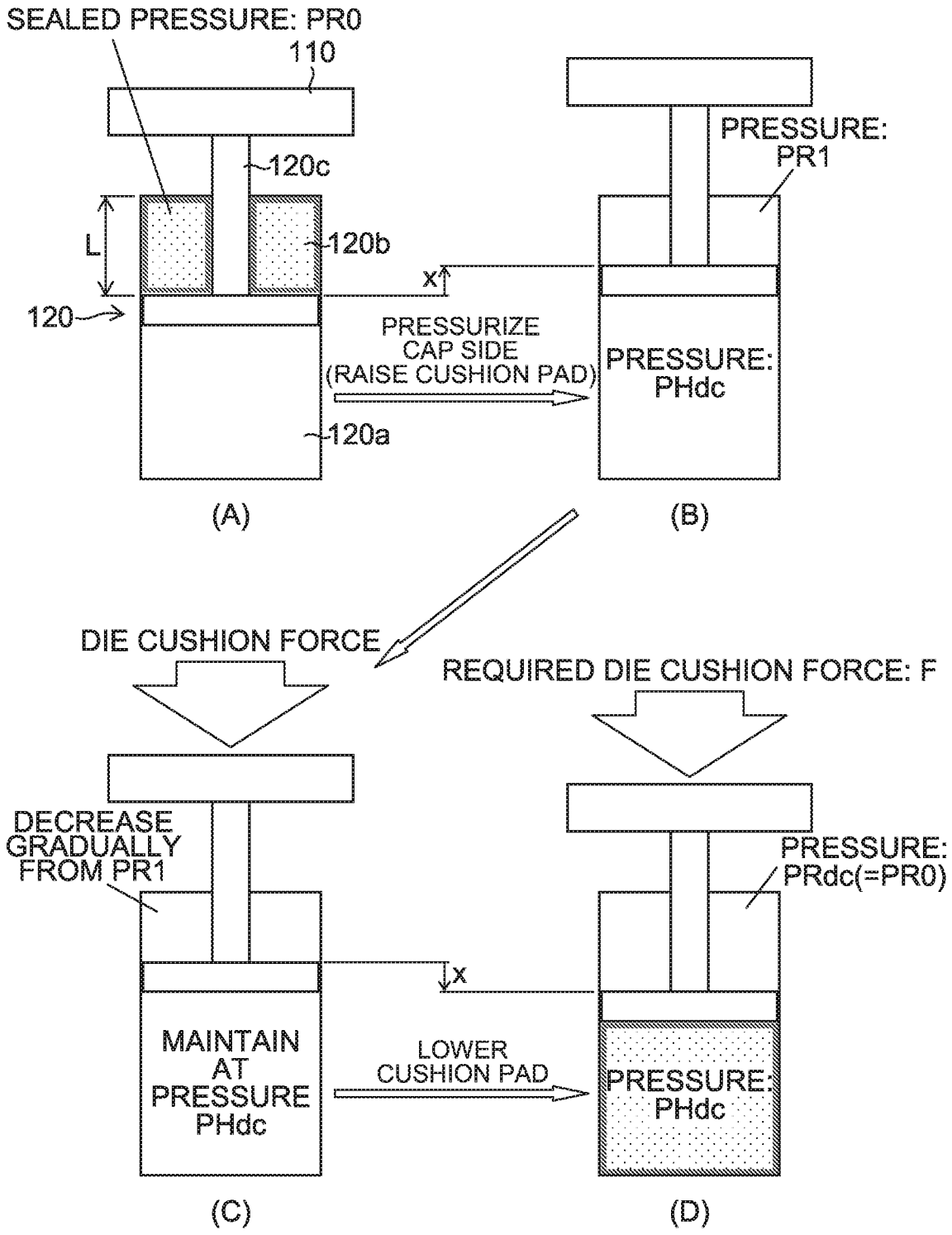
FIG. 3 illustrates transition of respective states of a hydraulic cylinder from a state where a cushion pad is positioned at a die cushion standby position to a state where a preset die cushion force is generated.

FIG. 3 illustrates transition of respective states of the hydraulic cylinder 120 from a state where a cushion pad is positioned at a die cushion standby position to a state where the preset die cushion force is generated.

Portion (A) in FIG. 3 illustrates the hydraulic cylinder 120 in a state where the cushion pad 110 is positioned (put on standby) at the die cushion standby position by the die cushion position control.

Since the depressure valve 144 is closed at the die cushion standby position, hydraulic oil in the rod side hydraulic chamber 120*b* of the hydraulic cylinder 120 is prevented from flowing out from the rod side hydraulic chamber 120*b* to become a sealed state.

At the time, pressure in the rod side hydraulic chamber 120*b* is indicated as PR0, and a dimension (length) of the rod side hydraulic chamber 120*b* in a stretching direction is indicated as L.

As illustrated in Portion (B) in FIG. 3, pressure oil is supplied to the cap side hydraulic chamber 120*a* of the hydraulic cylinder 120 from the state of Portion (A) in FIG. 3 to pressurize the cap side hydraulic chamber 120*a* until pressure therein reaches a preset pressure PHdc.

Pressurizing the cap side hydraulic chamber 120*a* to the pressure PHdc causes the sealed pressure PR0 in the rod side hydraulic chamber 120*b* of the hydraulic cylinder 120 to be pressure PR1 corresponding to the pressure PHdc in the cap side hydraulic chamber 120*a* as expressed in the following expression.

$$PR1=PHdc\cdot AH/AR, \text{ where} \qquad \text{[Expression 1]}$$

AH is a cross-sectional area of the cap side hydraulic chamber 120*a* of the hydraulic cylinder 120, and AR is a cross-sectional area of the rod side hydraulic chamber 120*b* of the hydraulic cylinder 120.

In the present example, a volume of sealed hydraulic oil includes only a volume of that in the rod side hydraulic chamber 120*b* of the hydraulic cylinder 120, and a volume of sealed hydraulic oil in piping connected to the rod side hydraulic chamber 120*b* is neglected for convenience of description. In addition, weight of the cushion pad 110 and the like is also neglected.

As illustrated in FIGS. 3A and 3B, pressurizing the cap side hydraulic chamber 120*a* of the hydraulic cylinder 120 to the pressure PHdc causes compression of a volume of hydraulic oil in the rod side hydraulic chamber 120*b* at the die cushion standby position. As a result, the piston rod 120*c* (cushion pad 110) of the hydraulic cylinder 120 is balanced by rising by the amount of a rise x from the die cushion standby position.

In the rod side hydraulic chamber 120*b* of the hydraulic cylinder 120, a relationship between pressure and volume in the rod side hydraulic chamber 120*b* after the volume in the rod side hydraulic chamber 120*b* is changed by pressurizing the cap side hydraulic chamber 120*a* can be expressed by the following expression.

$$P=P'+k\Delta V/V, \text{ where} \quad \text{[Expression 2]}$$

P is pressure in a hydraulic chamber after change in volume,

P' is pressure in the hydraulic chamber before the change in volume,

V is a volume in the hydraulic chamber before the change in volume,

ΔV is an amount of volume compression, and k is a volume elastic coefficient of hydraulic oil.

In addition, Expression 2 can be replaced with the following expression by using PR1, PR0, L, AR, AH, and the amount of a rise x.

$$PR1=PR0+k\cdot AR\cdot x/(AR\cdot L) \quad \text{[Expression 3]}$$

In addition, Expression 1 and Expression 3 are expressed as follows:

$$PHdc\cdot AH/AR=PR0+k\cdot x/L,$$

then, the amount of rise x can be expressed by the following expression.

$$x=(PHdc\cdot AH/AR-PR0)\cdot L/k, \quad \text{[Expression 4]}$$

thus, it is possible to calculate the amount of a rise x in the case where pressure in the cap side hydraulic chamber 120*a* is set at PHdc to acquire a required die cushion force F at a position required in design, by using Expression 4.

When the slide 14 descends from a state illustrated in Portion (B) in FIG. 3 and collides with the cushion pad 110 to cause the cushion pad 110 to descend together with the slide 14, pressure in the rod side hydraulic chamber 120*b* of the hydraulic cylinder 120 gradually decreases from the pressure PR1 (Portion (C) in FIG. 3). At this time, pressure in the cap side hydraulic chamber 120*a* is controlled to be maintained at the pressure PHdc. This allows the hydraulic cylinder 120 to generate die cushion force that gradually increases as the pressure in the rod side hydraulic chamber 120*b* gradually decreases.

When the cushion pad 110 is pressed by the amount of a rise x as illustrated in Portion (D) in FIG. 3 (the cushion pad 110 reaches the die cushion standby position), pressure PRdc in the rod side hydraulic chamber 120*b* of the hydraulic cylinder 120 returns to the pressure PR0 in the state of Portion (A) in FIG. 3 (PRdc=PR0), and then the hydraulic cylinder 120 generates the required die cushion force F.

The pressure PHdc in the cap side hydraulic chamber 120*a* of the hydraulic cylinder 120, required to acquire the required die cushion force F, can be calculated by using the following expression.

$$PHdc=(F+PRdc\cdot AR)/AH, \text{ where} \quad \text{[Expression 5]}$$

the pressure PRdc in the rod side hydraulic chamber 120*b* of the hydraulic cylinder 120, when the hydraulic cylinder 120 generates the required die cushion force F, is equal to the pressure PR0 (PRdc=PR0).

$$AR=\pi\cdot[(230/2)^2-(180/2)^2]\approx 16100 \text{ mm}^2,$$

$$AH=\pi\cdot(230/2)^2\approx 41548 \text{ mm}^2, \text{ where}$$

a cylinder inner diameter of the hydraulic cylinder 120 is 230 mm, a rod diameter of the piston rod 120*c* is 180 mm, a cylinder stroke is 400 mm, a desired die cushion force F is 500 kN, a cylinder position (a cylinder position corresponding to a cushion pad standby position) at which the die cushion force F is required is 350 mm above a stroke lower limit, an initial pressure PR0 in the rod side hydraulic chamber 120*b* is 0.7 MPa, and a volume elastic coefficient k of hydraulic oil is 1000 N/m$^2$. When these known values are substituted into Expression 4, the pressure PHdc is expressed as follows:

$$PHdc=(500000+0.7\cdot 16100)/41548\approx 12.3 \text{ MPa}.$$

In addition, when the known values above and the PHdc calculated are substituted into Expression 1, the pressure PR1 is expressed as follows:

$$PR1=12.3\cdot 41548/16100\approx 31.7 \text{ MPa}.$$

Further, L indicated in Portion (A) in FIG. 3 is as follows: L=300−250=50 mm, and when the known values and the calculated PHdc are substituted into Expression 4, the amount of a rise x is calculated as follows:

$$x=(12.3\cdot 41548/16100-0.7)\cdot 50/1000\approx 1.55 \text{ mm}.$$

When the cap side hydraulic chamber 120*a* of the hydraulic cylinder 120 is pressurized to cause pressure therein to be the pressure PHdc (12.3 MPa in the example above) before the die cushion force control starts, as described above, the cushion pad 110 rises by the amount of a rise x (about 1.55 mm). Meanwhile, when the slide 14 collides with the cushion pad 110 to cause the cushion pad 110 to descend by the amount of a rise x (reaches the die cushion standby position), the hydraulic cylinder 120 can generate a required die cushion force F (=500 kN).

That is, even if the cap side hydraulic chamber 120*a* of the hydraulic cylinder 120 is pressurized before the die cushion force control starts, the amount of a rise of the cushion pad 110 (hydraulic cylinder 120) is little, and die cushion force required at the die cushion standby position can be generated, thereby enabling increase in responsivity of action of die cushion force.

In addition, pressure in the cap side hydraulic chamber 120*a* pressurized before the die cushion force control starts may be more than pressure when the cushion pad 110 is moved to the die cushion standby position, as well as less than the pressure PHdc. Even if pressure in the cap side hydraulic chamber 120*a* of the hydraulic cylinder 120 cannot be increased to the pressure PHdc (or the amount of a rise x cannot be secured) due to restrictions such as strength of the rod side hydraulic chamber 120*b* of the hydraulic cylinder 120 and restriction on die structure depending on conditions, high responsivity can be achieved while the amount of a rise x is reduced by controlling pressure in the cap side hydraulic chamber 120*a* to cause the pressure to be the pressure PHdc at the time when the slide 14 and the cushion pad 110 collide with each other, or at the latest by the time the cushion pad 110 descends by the amount of a rise x, while the pressure PHdc is reduced (the amount of a rise x is reduced).

Second Embodiment of Die Cushion Device

Figure 4:
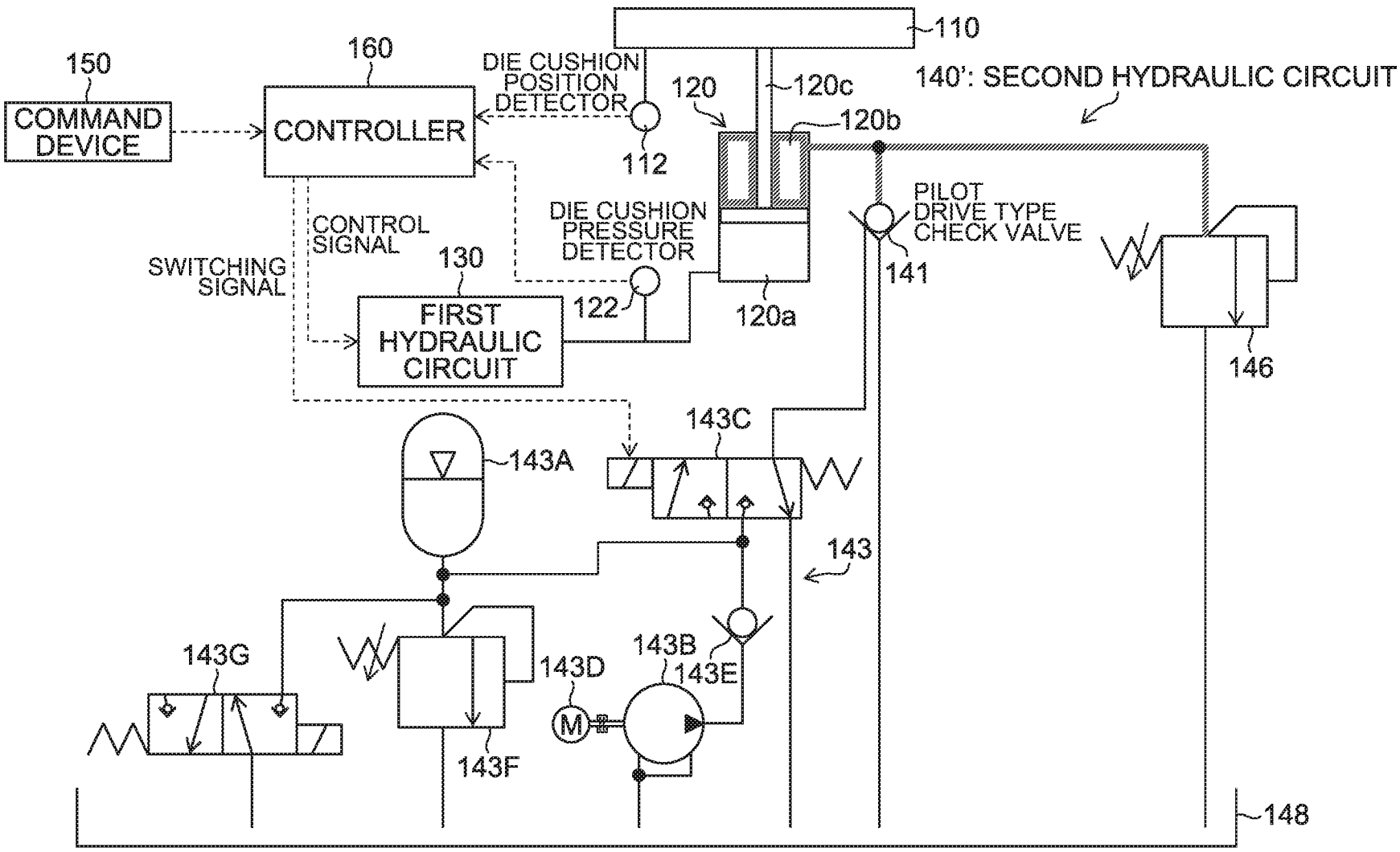
FIG. 4 is a structural diagram illustrating a second embodiment of the die cushion device according to the present invention.

FIG. 4 is a structural diagram illustrating a second embodiment of the die cushion device according to the present invention.

A die cushion device 100' of the second embodiment illustrated in FIG. 4 is different from the die cushion device 100 of the first embodiment illustrated in FIG. 1 in that a second hydraulic circuit 140' is used instead of the second hydraulic circuit 140. In FIG. 4, a component in common with the die cushion device 100 of the first embodiment illustrated in FIG. 1 is designated by the same reference numeral to eliminate duplicated description in detail.

The second hydraulic circuit 140' illustrated in FIG. 4 includes a pilot drive type check valve 141 and a pilot pressure generating device 143 instead of the check valve 142 and the depressure valve 144 of the second hydraulic circuit 140 illustrated in FIG. 1.

The pilot pressure generating device 143 generates pilot pressure for controlling opening/closing of the pilot drive type check valve 141, and includes an accumulator 143A for accumulating hydraulic oil under the pilot pressure, a hydraulic pump 143B for generating the pilot pressure, a solenoid changeover valve (3-port, 2-position solenoid valve) 143C for pilot operation, and the like.

The hydraulic pump 143B is driven by an electric motor 143D to supply pressure oil to the accumulator 143A through a check valve 143E. The hydraulic pump 143B is only driven when pressure of hydraulic oil accumulated in the accumulator 143A decreases to below a predetermined pilot pressure. Reference numeral 143F designates a relief valve that is used to prevent a hydraulic device from breaking by allowing pressure oil to flow out when the pilot pressure becomes abnormal pressure. Reference numeral 143G designates a relief valve that is used when the pilot pressure is reduced, and that is normally closed.

The solenoid changeover valve 143C is controlled (direction switching control) by a switching signal received from the controller 160, and is switched from a position illustrated in FIG. 4 to apply the pilot pressure to the pilot drive type check valve 141, when a solenoid of the solenoid changeover valve 143C is excited by the switching signal. This causes the pilot drive type check valve 141 to open to enable hydraulic oil in the rod side hydraulic chamber 120*b* of the hydraulic cylinder 120 to flow out from the rod side hydraulic chamber 120*b* to the tank 148 through the pilot drive type check valve 141.

Meanwhile, when the solenoid of the solenoid changeover valve 143C is demagnetized by a switching signal received from the controller 160, the solenoid changeover valve 143C is switched to a position illustrated in FIG. 4 to reduce the pilot pressure applied to the pilot drive type check valve 141, and then the pilot drive type check valve 141 is closed. This prevents hydraulic oil from flowing out from the rod side hydraulic chamber 120*b* of the hydraulic cylinder 120.

While the second hydraulic circuit 140' configured as above is different in configuration from the second hydraulic circuit 140 illustrated in FIG. 1, as with the second hydraulic circuit 140, the second hydraulic circuit 140' can prevent hydraulic oil from flowing out from the rod side hydraulic chamber 120*b* of the hydraulic cylinder 120, or enables hydraulic oil to flow out from the rod side hydraulic chamber 120*b* of the hydraulic cylinder 120, by using a switching signal from the controller 160.

Figure 5:
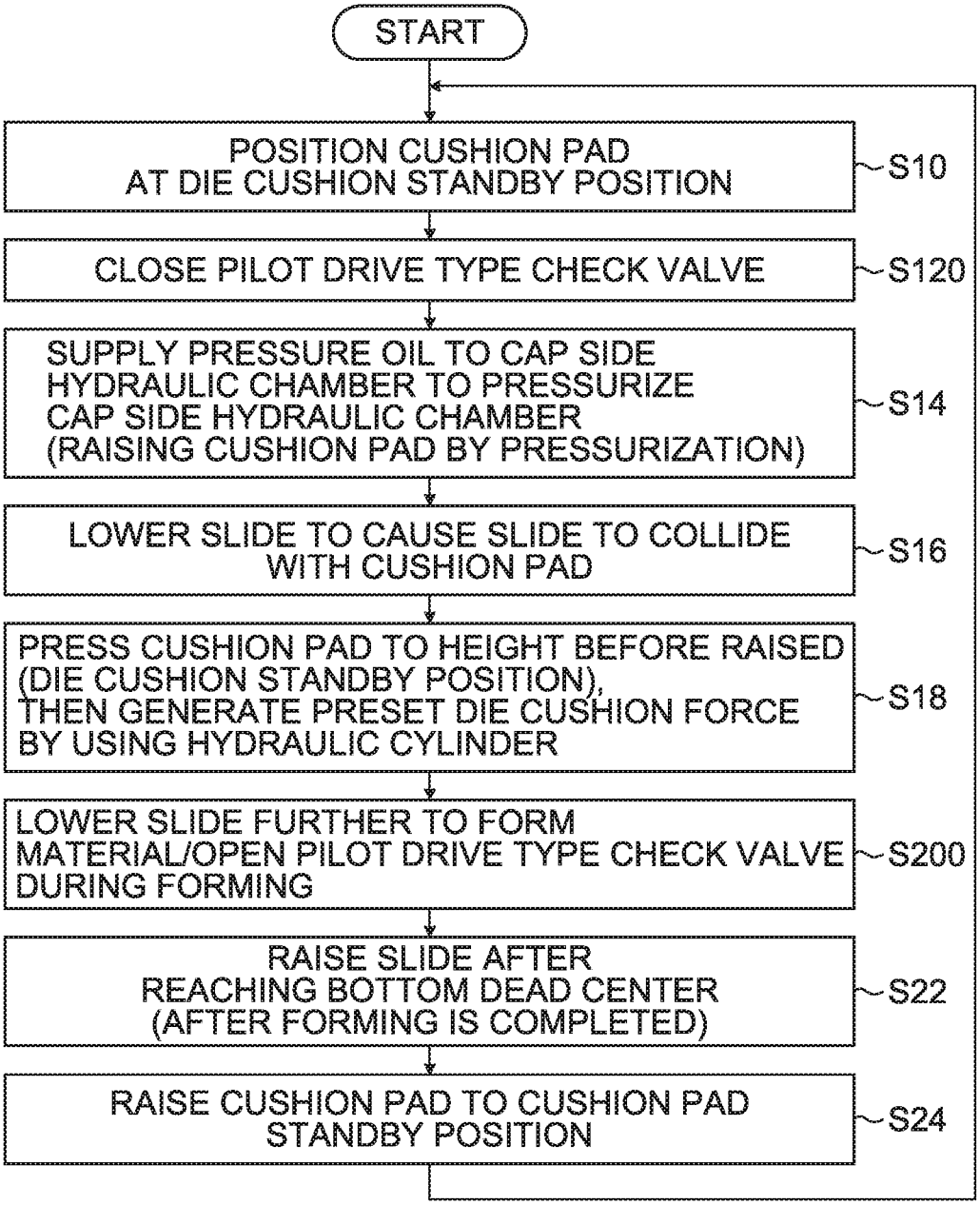
FIG. 5 is a flow chart illustrating a method of controlling a die cushion device, according to the present invention, and particularly a method of controlling the die cushion device of the second embodiment.

FIG. 5 is a flow chart illustrating a method of controlling the die cushion device 100' of the second embodiment above. A portion in common with the flow chart illustrated in FIG. 2 is designated by a common step number to eliminate duplicated description in detail.

The flow chart illustrated in FIG. 5 is different from the flow chart illustrated in FIG. 2 in that processes at step S120 and step S200 are performed instead of those at step S12 and step S20.

That is, while the depressure valve 144 is closed at step S12 in FIG. 2, the pilot drive type check valve 141 is closed to prevent hydraulic oil from flowing out from the rod side hydraulic chamber 120*b* of the hydraulic cylinder 120, thereby enabling the cap side hydraulic chamber 120*a* to be pressurized, at step S120.

While the depressure valve 144 is opened at step S20 in FIG. 2, the pilot drive type check valve 141 is opened at step S200. When the cushion pad 110 descends, hydraulic oil can flow into the rod side hydraulic chamber 120*b* of the hydraulic cylinder 120 through the pilot drive type check valve 141 even if pilot pressure is applied to the pilot drive type check valve 141, and thus the pilot drive type check valve 141 may be controlled to be opened by the time position control (rising) of the cushion pad 110 starts.

First Embodiment of First Hydraulic Circuit

Figure 6:
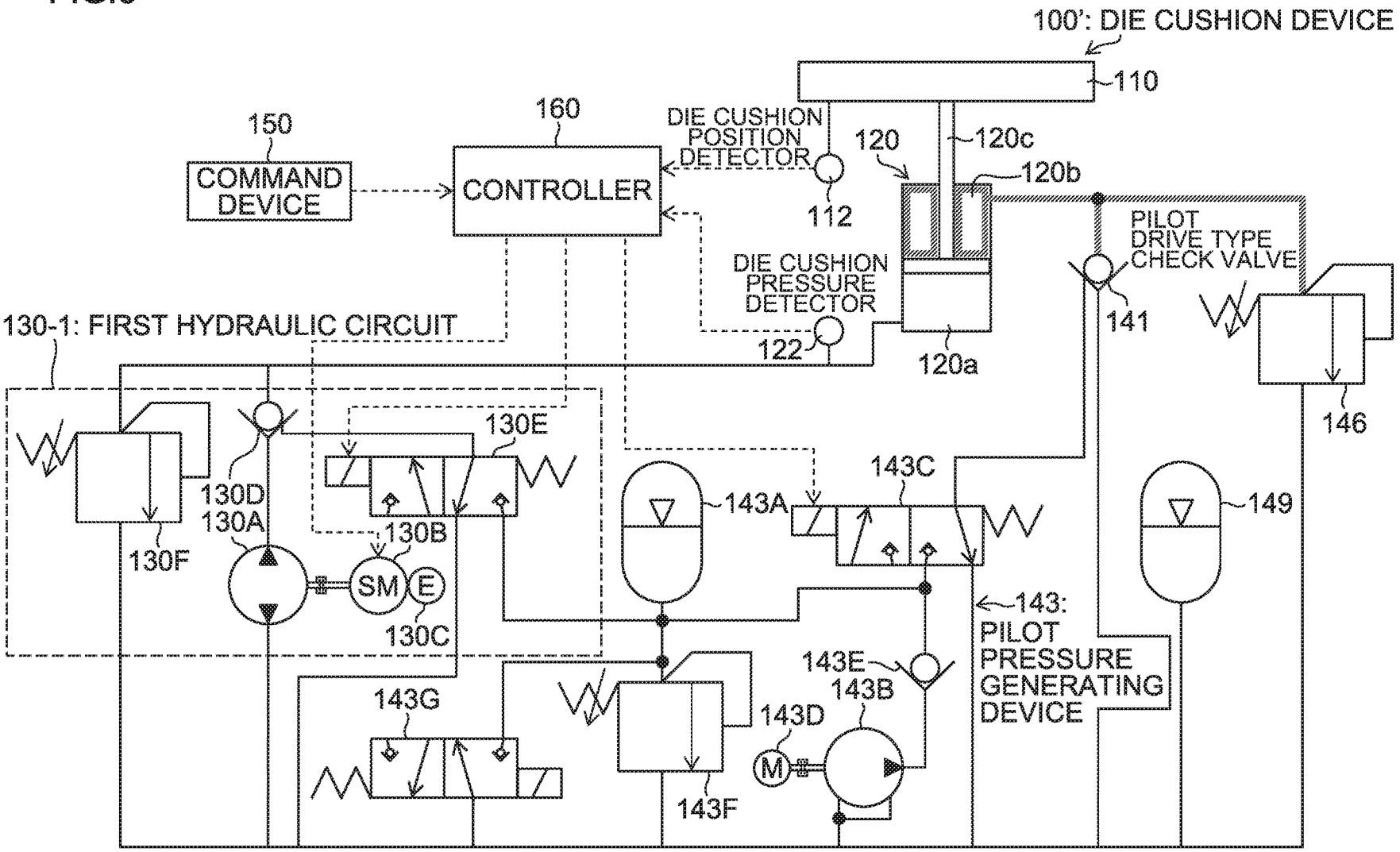
FIG. 6 is a structural diagram corresponding to the die cushion device of the second embodiment illustrated in FIG. 4, and is a structural diagram including particularly a first hydraulic circuit of the first embodiment.

FIG. 6 is a structural diagram corresponding to the die cushion device 100' of the second embodiment illustrated in FIG. 4, and is a structural diagram including particularly a first hydraulic circuit 130-1 of the first embodiment, corresponding to the first hydraulic circuit 130 illustrated in FIG. 1. The die cushion device 100' illustrated in FIG. 6 includes an accumulator 149 under a gas pressure of a low pressure (e.g. 0.7 MPa), serving as a tank, instead of the tank 148 illustrated in FIG. 4, the accumulator 149 being connected to a low pressure line.

The first hydraulic circuit 130-1 of the first embodiment illustrated in FIG. 6 includes: a hydraulic pump/motor (fluid-pressure pump/motor) 130A; a servo motor (electric motor) 130B connected to a rotating shaft of the hydraulic pump/motor 130A; an angular speed detector 130C that detects angular speed (servo motor angular speed ω) of a drive shaft of the servo motor 130B; a pilot drive type check valve 130D; a solenoid changeover valve 130E; and a relief valve 130F serving as a safety valve.

One port (discharge port) of the hydraulic pump/motor 130A is connected to the cap side hydraulic chamber 120*a* of the hydraulic cylinder 120 through the pilot drive type check valve 130D, and the other port is connected to the low pressure line to which the accumulator 149 is connected.

The die cushion pressure detector 122 detects pressure applied to the cap side hydraulic chamber 120*a* of the hydraulic cylinder 120, and the angular speed detector 130C detects angular speed of the drive shaft of the servo motor 130B.

Since die cushion force can be mainly expressed by the product of pressure in the cap side hydraulic chamber 120*a* of the hydraulic cylinder 120 and a surface area of the cylinder, controlling the die cushion force means controlling the pressure in the cap side hydraulic chamber 120*a* of the hydraulic cylinder 120.

Force transmitted to the hydraulic cylinder 120 through the cushion pad 110, after the slide 14 collides with the cushion pad 110, compresses the cap side hydraulic chamber 120*a* of the hydraulic cylinder 120 to generate die cushion pressure. Simultaneously, the die cushion pressure causes the hydraulic pump/motor 130A to serve as a hydraulic motor to rotate the servo motor 130B when rotating shaft torque generated in the hydraulic pump/motor 130A becomes equal to driving torque of the servo motor 130B, thereby preventing the die cushion pressure from rising.

Finally, the die cushion force is determined in accordance with drive torque of the servo motor 130B.

(Die Cushion Force Control)

At the time of die cushion force control, the command device 150 outputs a command value corresponding to a required die cushion force. In the present example, the cushion pad 110 is controlled in position, and a command value indicating the preset pressure PHdc is outputted when the cushion pad 110 reaches the die cushion standby position.

The controller 160 inputs a die cushion pressure detection signal indicating a pressure in the cap side hydraulic chamber 120*a* of the hydraulic cylinder 120 detected by the die cushion pressure detector 122 to control pressure in the cap side hydraulic chamber 120*a* of the hydraulic cylinder 120 as indicated by the command value received from the command device 150. In addition, the controller 160 inputs a servo motor angular speed signal indicating an angular speed (servo motor angular speed (ω)) of the drive shaft of the servo motor 130B, as an angular speed feedback signal to secure dynamic stability of die cushion force.

When the cushion pad 110 reaches the die cushion standby position and control is switched from the die cushion position control state to the die cushion force control state, the controller 160 outputs a torque command calculated by using a command value corresponding to die cushion force, a die cushion pressure detection signal, and a servo motor angular speed signal to the servo motor 130B through an amplifier (not illustrated), thereby performing the die cushion force control.

Before the slide 14 collides with the cushion pad 110 (before the die cushion force control starts), as illustrated in Portion (B) in FIG. 3, even if pressure in the cap side hydraulic chamber 120*a* of the hydraulic cylinder 120 is controlled to be the pressure PHdc corresponding to the command value, pressure in the rod side hydraulic chamber 120*b* of the hydraulic cylinder 120 increases to the pressure PR1 to cause the cushion pad 110 to be at rest while pressure in both the chambers is balanced, whereby no die cushion force is generated.

When pressure in the cap side hydraulic chamber 120*a* of the hydraulic cylinder 120 reaches the pressure PHdc while the pilot drive type check valve 130D is controlled to be closed by the solenoid changeover valve 130E, it is preferable that the servo motor 130B is controlled to be stopped until the slide 14 collides with the cushion pad 110. This enables elimination of waste of power consumption by the servo motor 130B. Even if the servo motor 130B is stopped, the pressure PHdc in the cap side hydraulic chamber 120*a* can be maintained by the pilot drive type check valve 130D.

When the slide 14 descends and collides with the cushion pad 110, the controller 160 starts torque control of the servo motor 130B, and controls (switches) the solenoid changeover valve 130E to open the pilot drive type check valve 130D.

While the slide 14 descends to the bottom dead center after colliding with the cushion pad 110 (during forming), a direction of torque output of the servo motor 130B and that of generation speed are opposite to each other. That is, pressure oil flows into the hydraulic pump/motor 130A from the cap side hydraulic chamber 120*a* of the hydraulic cylinder 120 through the pilot drive type check valve 130D by using power received by the cushion pad 110 from the slide 14 to cause the hydraulic pump/motor 130A to serve as a hydraulic motor. Since the servo motor 130B is driven by the hydraulic pump/motor 130A to serve as a generator, it is preferable to use electric power generated by the servo motor 130B as regenerative power.

(Control of Die Cushion Position)

The command device 150 causes knock-out operation for a product to be performed after the slide 14 reaches the bottom dead center and the die cushion force control is finished, and outputs a command value (position command value) of controlling position of the cushion pad 110 to cause the cushion pad 110 to move (rise) to the die cushion standby position.

In the case of the die cushion position control state, the controller 160 controls the servo motor 130B on the basis of a position command value received from the command device 150 and a detection signal of die cushion position detected by the die cushion position detector 112 to cause the hydraulic pump/motor 130A to supply pressure oil to the cap side hydraulic chamber 120*a* of the hydraulic cylinder 120.

Accordingly, controlling a position in a stretching direction of the piston rod 120*c* of the hydraulic cylinder 120 enables control of a position (die cushion position) in a lifting direction of the cushion pad 110.

Second Embodiment of First Hydraulic Circuit

Figure 7:
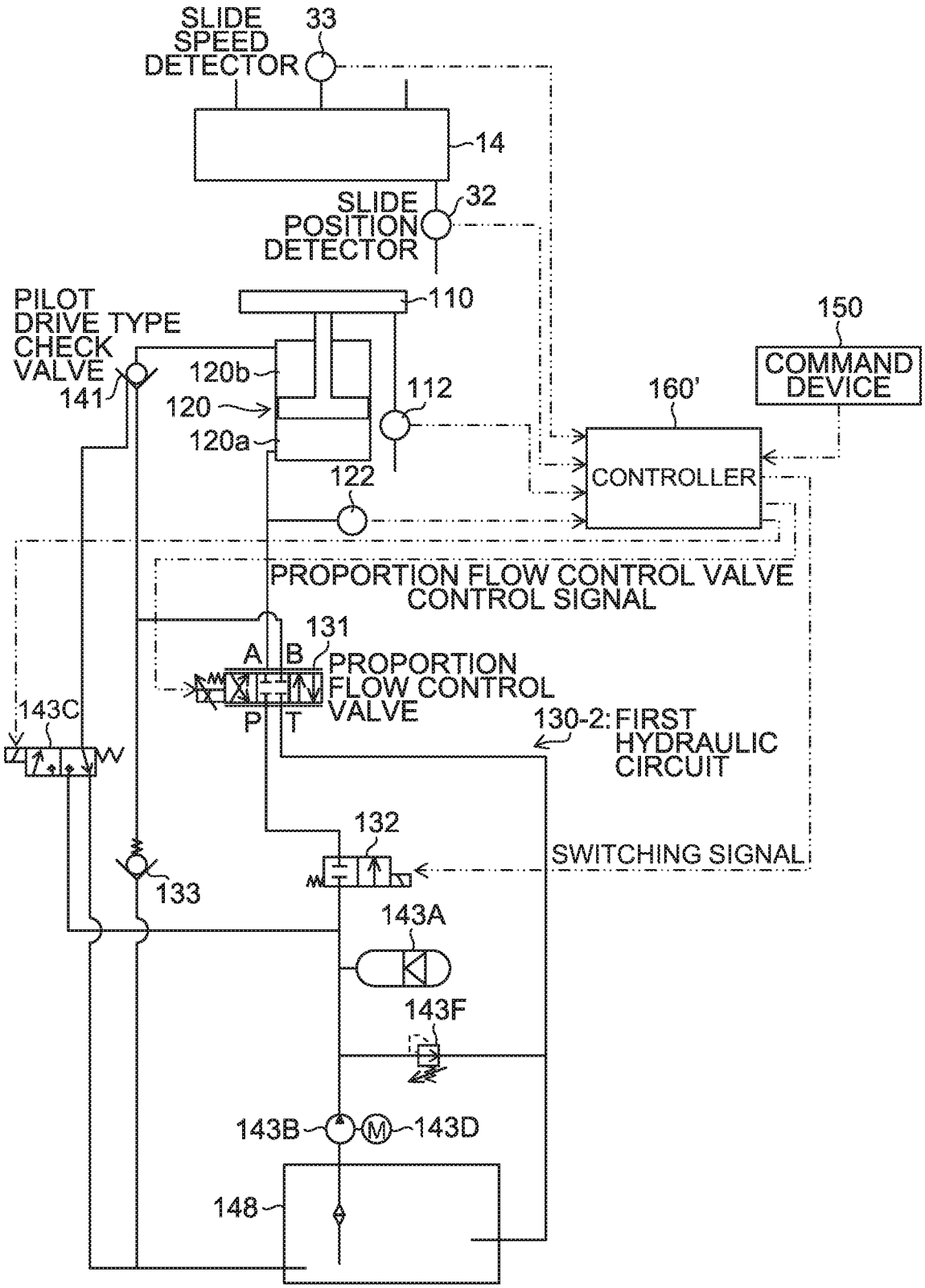
FIG. 7 is a structural diagram corresponding to the die cushion device of the second embodiment illustrated in FIG. 4, and is a structural diagram including particularly a first hydraulic circuit of the second embodiment.

FIG. 7 is a structural diagram corresponding to the die cushion device 100' of the second embodiment illustrated in FIG. 4, and is a structural diagram including particularly the first hydraulic circuit 130-2 of the second embodiment.

The first hydraulic circuit 130-2 of the second embodiment illustrated in FIG. 6 includes a 4-port, 2-position proportion flow control valve (hereinafter referred to as simply a "proportion flow control valve") 131, a solenoid changeover valve 132, a check valve 133, a pressure oil supply source with an accumulator 143A (including the hydraulic pump 143B, the electric motor 143D, and the relief valve 143F), and the like.

The die cushion pressure detector 122 for detecting pressure in the cap side hydraulic chamber 120*a* as well as an A port of the proportion flow control valve 131 is connected to a flow channel connected to the cap side hydraulic chamber 120*a* of the hydraulic cylinder 120, and a flow channel connected to the rod side hydraulic chamber 120*b* of the hydraulic cylinder 120 is connected to a B port of the proportion flow control valve 131 through the pilot drive type check valve 141 as well as to the tank 148 through the check valve 133.

A pressure supply port (P port) of the proportion flow control valve 131 is connected to the pressure oil supply source with the accumulator 143A through the solenoid changeover valve 132 that can be opened and closed, and a T port of the proportion flow control valve 131 is connected to the tank 148.

The accumulator 143A is set under high pressure gas pressure to hold pressure oil under high pressure. The pressure oil under high pressure is supplied to the cap side hydraulic chamber 120*a* of the hydraulic cylinder 120 through the solenoid changeover valve 132 and the proportion flow control valve 131 to raise the cushion pad 110, and is supplied as pilot pressure of the pilot drive type check valve 141 through the solenoid changeover valve 143C, at the time of the die cushion position control.

Meanwhile, the slide 14 of the press machine is provided with a slide position detector 32 and a slide speed detector 33.

Respective detection signals of the slide position detector 32, the slide speed detector 33, the die cushion position detector 112, and the die cushion pressure detector 122 are received by a controller 160'. The controller 160' is configured to receive a command value indicating a die cushion force or a die cushion pressure corresponding to the die cushion force, and a command value indicating a position (die cushion position) such as a knock-out position and a die cushion standby position, from the command device 150.

The controller 160' is configured to perform the die cushion force control and the die cushion position control, and outputs not only a control signal for controlling the proportion flow control valve 131, but also a switching signal for switching the solenoid changeover valves 132 and 143C, on the basis of the command values above and the detection signals above.

(Principle of Die Cushion Force Control)

Since die cushion force can be expressed by the product of pressure in the cap side hydraulic chamber 120*a* of the hydraulic cylinder 120 and a surface area of the cylinder, controlling the die cushion force means controlling the pressure in the cap side hydraulic chamber 120*a* of the hydraulic cylinder 120.

Pressure P in the cap side hydraulic chamber 120*a* of the hydraulic cylinder 120 can be expressed by the following expression.

$$P=(K/V)\cdot q\cdot(1/s), \quad \text{[Expression 6]}$$

where each symbol means the following:

K is a volume elastic coefficient;

V is a volume in a lower chamber of a cylinder [$cm^3$];

q is a flow rate of in- and outflow to the lower chamber of the cylinder [$cm^3/s$]; and 1/s is integration.

From Expression 6, it can be seen that pressure (die cushion force) can be controlled if a flow rate q of in- and outflow to the cap side hydraulic chamber 120*a* can be controlled.

Using Bernoulli equation, an outflow Q from the cap side hydraulic chamber 120*a* through the proportion flow control valve 131 can be expressed by the following expression using a valve coefficient Kv proportional to an opening of the proportion flow control valve 131, and the pressure P in the cap side hydraulic chamber 120*a*.

$$Q=Kv\sqrt{P} \quad \text{[Expression 7]}$$

$$Kv=Cd\cdot\pi\cdot d\sqrt{(2/\rho)}\cdot x=C\cdot x \text{ (C is a constant)}, \quad \text{[Expression 8]}$$

where each symbol in Expression 7 and Expression 8 means the following:

P is pressure [$kgf/cm^2$];

Q is a flow rate [$cm^3/s$] through a proportion flow control valve;

ρ is hydraulic oil density [$kgf\ s^2/cm^4$];

Cd is a flow rate coefficient;

d is a spool diameter [cm] of the proportion flow control valve; and x is a spool displacement [cm] of the proportion flow control valve 131.

The flow rate q of in- and outflow to the cap side hydraulic chamber 120*a* is acquired by subtracting the outflow Q from an inflow Qs (q=Qs−Q). Since the inflow Qs is determined by the product of slide speed (descent speed of a piston of a cylinder) and a surface area of the cylinder, controlling the outflow Q from the cap side hydraulic chamber 120*a* enables control of pressure in cap side hydraulic chamber 120*a*.

The valve coefficient Kv is proportional to the spool displacement x of the proportion flow control valve 131 as expressed by Expression 8, and the proportion flow control valve 131 has a spool position that varies in proportion to a proportion flow control valve command. Thus, if pressure difference is constant, a flow rate of hydraulic oil is determined in proportion to the proportion flow control valve command.

Expression 7 can be varied to the following expression.

$$Kv=Q/\sqrt{P} \quad \text{[Expression 9]}$$

The valve coefficient Kv can be acquired by substituting command pressure of die cushion indicated as Pr, and a flow rate acquired by slide speed indicated as Qs, for P and Q in Expression 9, respectively. If the proportion flow control valve 131 is controlled to have a spool displacement (opening) corresponding to the valve coefficient Kv, the pressure P in the cap side hydraulic chamber 120*a* can be controlled to be the command pressure Pr.

That is, if the pressure P in the cap side hydraulic chamber 120*a* is less than the command pressure Pr (P<Pr), the outflow Q through the proportion flow control valve 131 is less than the inflow Qs into the cap side hydraulic chamber 120*a* (Q<Qs). At the time, the flow rate q (=Qs−Q) of in- and outflow to the cap side hydraulic chamber 120*a* increases, as well as the pressure P in the cap side hydraulic chamber 120*a* increases. When the pressure P in the cap side hydraulic chamber 120*a* equals the command pressure Pr (P=Pr), the outflow Q from the cap side hydraulic chamber 120*a* also equals the inflow Qs (Q=Qs), and then the pressure P in a lower chamber of the cylinder is maintained at the command pressure Pr.

(Control of Die Cushion Pressure)

At the time of die cushion force control, the command device 150 outputs a command value corresponding to a required die cushion force. In the present example, the cushion pad 110 is controlled in position, and a command value indicating the preset pressure PHdc is outputted when the cushion pad 110 reaches the die cushion standby position. While it is preferable that the pressure oil supply source with the accumulator 143A supplies pressure oil under the pressure PHdc, pressure oil under pressure less than the pressure PHdc may be supplied.

When the cushion pad 110 reaches the die cushion standby position and control is switched from the die cushion position control state to the die cushion force control state, the controller 160' outputs a switching signal for demagnetizing a solenoid of the solenoid changeover valve 143C to cause no pilot pressure to be applied to the pilot drive type check valve 141, thereby closing the pilot drive type check valve 141. In addition, the controller 160' outputs a control signal to each of the solenoid changeover valve 132 and the proportion flow control valve 131 to cause the pressure oil supply source with the accumulator 143A to supply pressure oil under high pressure to the cap side hydraulic chamber 120*a* of the hydraulic cylinder 120 through the solenoid changeover valve 132 and the proportion flow control valve 131, thereby pressurizing the cap side hydraulic chamber 120*a* to cause pressure therein to be the same as the pressure in the accumulator 143A.

Before the slide 14 collides with the cushion pad 110 (before the die cushion force control starts), even if pressure in the cap side hydraulic chamber 120*a* of the hydraulic cylinder 120 is increased, pressure in the rod side hydraulic chamber 120*b* increases to cause the cushion pad 110 to be at rest while pressure in both the chambers is balanced because hydraulic oil is prevented from flowing out from the rod side hydraulic chamber 120*b*, whereby no die cushion force is generated.

While the slide 14 descends and the slide 14 reaches the bottom dead center after colliding with the cushion pad 110

(during forming), the controller 160' outputs not only a switching signal for closing the solenoid changeover valve 132 to close the P port of the proportion flow control valve 131, but also a pressure command corresponding to a preset die cushion force and a control signal for the proportion flow control valve, calculated on the basis of slide speed, to the proportion flow control valve 131 to cause the proportion flow control valve 131 to have an appropriate opening. Accordingly, a flow rate (an outflow from the cap side hydraulic chamber 120*a* of the hydraulic cylinder 120) through the proportion flow control valve 131 is controlled, whereby pressure in the cap side hydraulic chamber 120*a* is controlled to be pressure allowing required die cushion force to be generated.

(Control of Die Cushion Position)

The command device 150 causes knock-out operation for a product to be performed after the slide 14 reaches the bottom dead center and the die cushion force control is finished, and outputs a command value (position command value) of controlling position of the cushion pad 110 to cause the cushion pad 110 to move (rise) to the die cushion standby position.

In the case of the die cushion position control state, the controller 160' outputs a switching signal for opening the solenoid changeover valve 132 to open the P port of the proportion flow control valve 131, and causes a solenoid of the solenoid changeover valve 143C to be excited to apply pilot pressure to the pilot drive type check valve 141 through the solenoid changeover valve 143C to open the pilot drive type check valve 141, thereby enabling hydraulic oil to flow out from the rod side hydraulic chamber 120*b*. Subsequently, the controller 160' controls an opening of the proportion flow control valve 131 on the basis of a position command value from the command device 150 and a die cushion position signal from the die cushion position detector 112 to cause the cushion pad 110 to move to the die cushion standby position.

Comparative Example

Next, the die cushion device according to the present invention and a conventional die cushion device will be compared in a configuration and an operation effect.

The conventional die cushion device is controlled to cause a cushion pad to stop at a position above a cushion pad standby position by a predetermined amount before die cushion force control starts, and then a slide collides with the cushion pad and the cushion pad is pressed down to a height before rising to generate die cushion force corresponding to a setting pressure. In a state where the cushion pad stops at the position above the cushion pad standby position by the predetermined amount, hydraulic oil in a rod side hydraulic chamber of a hydraulic cylinder can freely flow in and out. Thus a cap side hydraulic chamber and the rod side hydraulic chamber of the hydraulic cylinder are not (cannot be) pressurized to high pressure.

Figure 8:
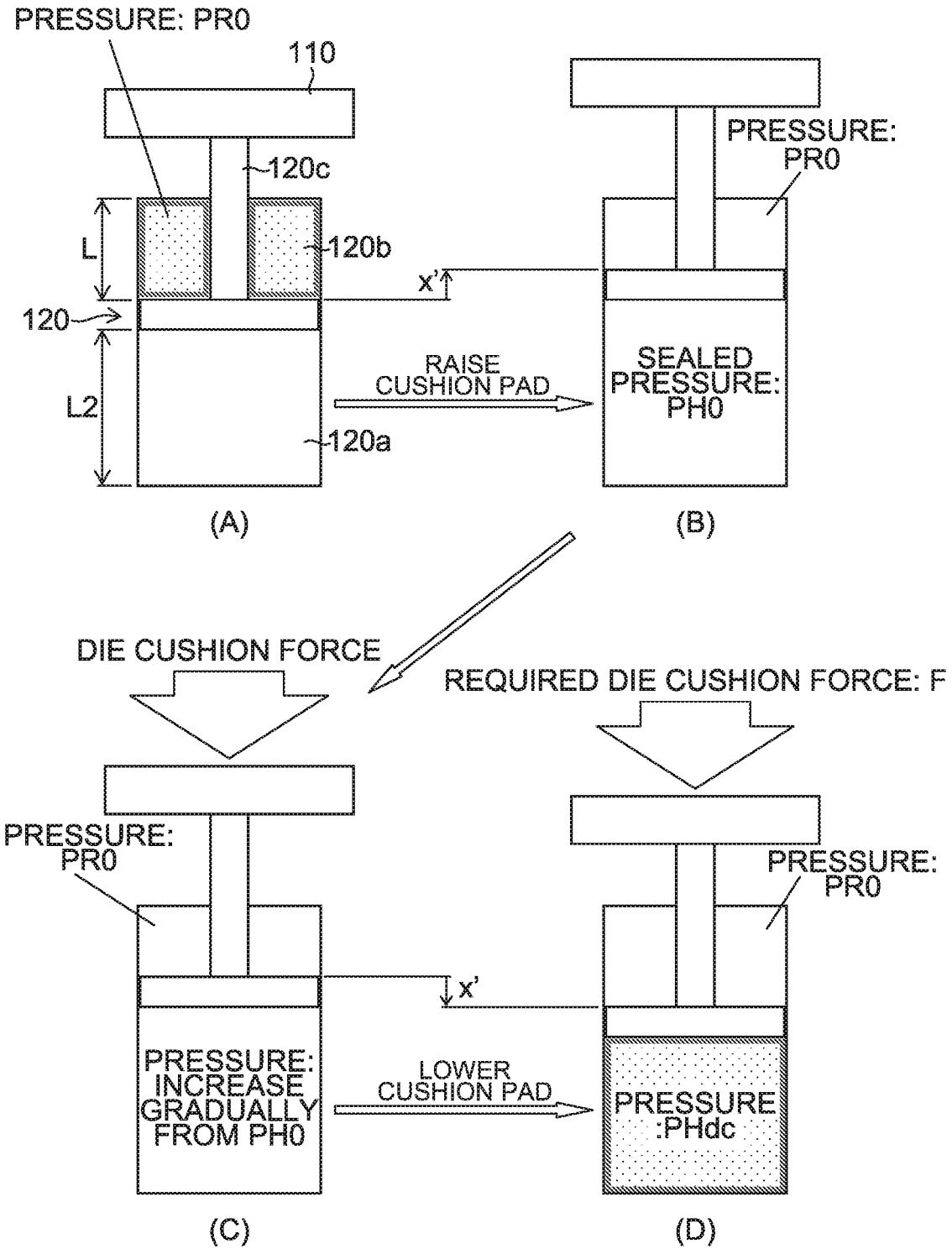
FIG. 8 illustrates transition of respective states of a hydraulic cylinder of a conventional die cushion device from a state where a cushion pad is positioned at a die cushion standby position to a state where the preset die cushion force is generated.

FIG. 8 illustrates transition of respective states of a hydraulic cylinder 120 of the conventional die cushion device from a state where a cushion pad 110 is positioned at a die cushion standby position to a state where the preset die cushion force is generated.

Portion (A) in FIG. 8 illustrates the hydraulic cylinder 120 in a state where the cushion pad 110 is positioned (put on standby) at the die cushion standby position by the die cushion position control.

At the time, pressure in a rod side hydraulic chamber 120*b* is indicated as PR0, a dimension (length) of the rod side hydraulic chamber 120*b* in a stretching direction is indicated as L, and a dimension (length) of a cap side hydraulic chamber 120*a* in the stretching direction is indicated as L2.

As illustrated in Portion (B) in FIG. 8, position control of the cushion pad is further performed in the state of Portion (A) in FIG. 8 to raise the cushion pad 110 (piston rod 120*c*) by a predetermined amount of a rise x' from the cushion pad standby position. At the time, pressure in the cap side hydraulic chamber 120*a* of the hydraulic cylinder 120 is to be pressure PH0, and pressure in the rod side hydraulic chamber 120*b* is to be pressure PR0.

For convenience of description, volume of sealed hydraulic oil includes only volume of that in the cap side hydraulic chamber 120*a* of the hydraulic cylinder 120, and volume of sealed hydraulic oil in piping is neglected. In addition, since it is considered that volume in the rod side hydraulic chamber 120*b* is sufficiently large, weight of the cushion pad 110 and the like is neglected.

The sealed pressure PH0 in the cap side hydraulic chamber 120*a* of the hydraulic cylinder 120 can be expressed by the following expression, where pressure in the rod side hydraulic chamber 120*b* is indicated as the pressure PR0.

$$PH0=PR0\cdot AR/AH, \text{ where} \quad \text{[Expression 10]}$$

AH is a cross-sectional area of the cap side hydraulic chamber 120*a* of the hydraulic cylinder 120, and AR is a cross-sectional area of the rod side hydraulic chamber 120*b* of the hydraulic cylinder 120.

In the present example, volume of sealed hydraulic oil includes only volume of that in the rod side hydraulic chamber 120*b* of the hydraulic cylinder 120, and volume of sealed hydraulic oil in piping connected to the rod side hydraulic chamber 120*b* is neglected for convenience of description. In addition, weight of the cushion pad 110 and the like is also neglected.

When the slide 14 descends from a state illustrated in Portion (B) in FIG. 8 and collides with the cushion pad 110 to cause the cushion pad 110 to descend together with the slide 14, pressure in the rod side hydraulic chamber 120*b* of the hydraulic cylinder 120 gradually increases from the pressure PR0 (Portion (C) in FIG. 8).

When the cushion pad 110 is pressed by the amount of a rise x' as illustrated in Portion (D) in FIG. 8 (the cushion pad 110 reaches the die cushion standby position), pressure in the cap side hydraulic chamber 120*a* of the hydraulic cylinder 120 is caused to be a predetermined pressure PHdc, and then the hydraulic cylinder 120 generates required die cushion force F. In other words, the amount of a rise x' of the cushion pad 110 is determined to cause the pressure PH0 before change in volume to be the pressure PHdc due to change in volume in the cap side hydraulic chamber 120*a* when the cushion pad 110 is pressed by the amount of a rise x'.

In the cap side hydraulic chamber 120*a* of the hydraulic cylinder 120, a relationship between pressure and volume in the cap side hydraulic chamber 120*a* after the volume in the cap side hydraulic chamber 120*a* is changed can be expressed by the following expression.

$$P=P'+k\Delta V/V, \text{ where} \quad \text{[Expression 11]}$$

P is pressure in a hydraulic chamber after change in volume,

P' is pressure in the hydraulic chamber before the change in volume,

V is a volume in the hydraulic chamber before the change in volume,

ΔV is an amount of volume compression, and k is a volume elastic coefficient of hydraulic oil.

In addition, Expression 11 can be replaced with the following expression by using PHdc, PH0, L2, AR, AH, and the amount of a rise x'.

$$PHdc=PH0+k\cdot AH\cdot x'/(AH\cdot L2)$$

$$x'=(PHdc-PH0)\cdot L2/k \quad \text{[Expression 12]}$$

In addition, the pressure PHdc in the cap side hydraulic chamber 120*a* of the hydraulic cylinder 120, required to acquire the required die cushion force F, can be calculated by using the following expression.

$$PHdc=(F+PR0\cdot AR)/AH \quad \text{[Expression 13]}$$

Thus, the amount of a rise x' can be expressed by the flowing expression by using Expression 12 and Expression 13.

$$x'=[(F+PR0\cdot AR)/AH-PH0]\cdot L2/k \quad \text{[Expression 14]}$$

Thus, it is possible to calculate the amount of a rise x' in the case where pressure in the cap side hydraulic chamber 120*a* is set at PHdc to acquire the required die cushion force F at a position required in design, by using Expression 14.

The PHdc and the PH0 are acquired as follows by using the same values as the known values used for the die cushion device according to the present invention described with reference to FIG. 3.

$$PHdc=(500000+0.7\cdot 16100)/41548\approx 12.3 \text{ MPa}$$

$$PH0=0.7\cdot 16100/41548\approx 0.27 \text{ MPa}$$

Then, the amount of a rise x' is calculated as follows by substituting the PHdc and the PH0 into Expression 12.

$$x'=(12.3-0.27)\cdot 350/1000\approx 4.21 \text{ mm}$$

With reference to the amount of a rise x (about 1.55 mm) of the cushion pad 110 when the cap side hydraulic chamber 120*a* is pressurized to cause pressure therein to be the PHdc while hydraulic oil in the rod side hydraulic chamber 120*b* of the hydraulic cylinder 120 is prevented from flowing out before die cushion force control starts, as with the die cushion device according to the present invention, the conventional die cushion device (without preventing hydraulic oil in the rod side hydraulic chamber 120*b* of the hydraulic cylinder 120 from flowing out) needs the amount of a rise x' (about 4.21 mm) by which the cushion pad rises to acquire die cushion force required at the die cushion standby position, the amount of a rise x' being almost three times the amount of a rise x.

[Others]

The hydraulic cylinder may be provided not only at one place in the cushion pad, as with the present embodiment, but also at two places of the front and rear of the cushion pad, or at four places of the front and rear, and the right and left, of the cushion pad, for example. In addition, a hydraulic circuit and a method of controlling it, causing a hydraulic cylinder to generate required die cushion force, are not limited to those of the present embodiment, and various types are available.

In the present embodiment, while the die cushion device in which oil is used for operation fluid is described, besides this, water or another liquid may be used. That is, while the present embodiment is described by using the form in which a hydraulic cylinder and a hydraulic circuit are used, besides this, a fluid-pressure cylinder and a fluid-pressure circuit in which water or another liquid is used can be obviously used for the present invention.

In addition, the present invention is not limited the examples above, and therefore it is needless to say that various modifications and variations are possible within a range not departing from the essence of the present invention.

What is claimed is:

1. A die cushion device comprising:

a fluid-pressure cylinder that 1) supports a cushion pad and 2) generates a die cushion force while a slide of a press machine descends, the fluid cylinder including a rod side fluid-pressure chamber and a cap side fluid-pressure chamber;

a die cushion force controller that controls a pressure in the cap side fluid-pressure chamber of the fluid-pressure cylinder to start die cushion force control when the slide descends and reaches a position at which the slide collides with the cushion pad, and that finishes the die cushion force control when the slide reaches a bottom dead center;

a first fluid-pressure circuit that supplies pressure fluid to the cap side fluid-pressure chamber of the fluid-pressure cylinder;

a second fluid-pressure circuit that prevents operation fluid from flowing out from the rod side fluid-pressure chamber of the fluid-pressure cylinder, or that enables the operation fluid to flow into the rod side fluid-pressure chamber; and a pressurization controller that, before starting the die cushion force control by the die cushion force controller, controls the second fluid-pressure circuit to prevent the operation fluid from flowing out from the rod side fluid-pressure chamber of the fluid-pressure cylinder, and controls the first fluid-pressure circuit to supply the pressure fluid to the cap side fluid-pressure chamber of the fluid-pressure cylinder while preventing the operation fluid from flowing out from the rod side fluid-pressure chamber to pressurize the cap side fluid-pressure chamber.

2. The die cushion device according to claim 1, wherein the second fluid-pressure circuit includes a check valve that prevents the operation fluid from flowing out from the rod side fluid-pressure chamber of the fluid-pressure cylinder, and a depressure valve that is provided parallel to the check valve, and the pressurization controller controls the depressure valve, before starting the die cushion force control, to cause the depressure valve to close, and to prevent the operation fluid from flowing out from the rod side fluid-pressure chamber of the fluid-pressure cylinder.

3. The die cushion device according to claim 1, wherein the second fluid-pressure circuit includes a pilot-driven check valve that prevents the operation fluid from flowing out from the rod side fluid-pressure chamber of the fluid-pressure cylinder, and the pressurization controller controls pilot pressure, before starting the die cushion force control, to cause the pilot-driven check valve to close, and to prevent the operation fluid from flowing out from the rod side fluid-pressure chamber of the fluid-pressure cylinder.

4. The die cushion device according to claim 1, further comprising a die cushion position controller configured to allow the operation fluid to be supplied to the cap side fluid-pressure chamber of the fluid-pressure cylinder to raise the cushion pad to a predetermined die cushion standby position after the die cushion force control is finished, wherein after the cushion pad is moved to the die cushion standby position by the die cushion position controller and before re-starting the die cushion force control, the pressurization controller allows the pressure fluid to be supplied to the cap side fluid-pressure chamber of the fluid-pressure cylinder by controlling the second fluid-pressure circuit while the operation fluid is prevented from flowing out from the rod side fluid-pressure chamber of the fluid-pressure cylinder by controlling the second fluid-pressure circuit.

5. The die cushion device according to claim 1, wherein pressure in the cap side fluid-pressure chamber of the fluid-pressure cylinder pressurized by the pressurization controller is equal to pressure at which the fluid-pressure cylinder generates a preset die cushion force.

6. The die cushion device according to claim 4, wherein pressure in the cap side fluid-pressure chamber of the fluid-pressure cylinder pressurized by the pressurization controller is more than pressure at which the cushion pad is moved to the die cushion standby position as well as less than pressure at which the fluid-pressure cylinder generates a preset cushion force.

7. The die cushion device according to claim 1, further comprising:

a pressure detector that detects pressure in the cap side fluid-pressure chamber of the fluid-pressure cylinder;

a fluid-pressure pump/motor with a discharge port connected to the cap side fluid-pressure chamber of the fluid-pressure cylinder through piping;

an electric motor connected to a rotating shaft of the fluid-pressure pump/motor;

a die cushion pressure command device that outputs a preset die cushion pressure command; and a die cushion force controller that controls torque of the electric motor based on the die cushion pressure command and pressure detected by the pressure detector to cause die cushion pressure to be equal to a pressure corresponding to the die cushion pressure command.

8. The die cushion device according to claim 7, wherein before die cushion force control starts, the pressurization controller controls torque of the electric motor to control fluid-pressure to be supplied to the cap side fluid-pressure chamber of the fluid-pressure cylinder.

9. The die cushion device according to claim 1, further comprising:

a proportion flow control valve provided in piping connected to the cap side fluid-pressure chamber of the fluid-pressure cylinder; and a die cushion force controller that controls opening of the proportion flow control valve to cause a flow rate of the operation fluid discharged from the cap side fluid-pressure chamber of the fluid-pressure cylinder to be controlled to control the pressure in the cap side fluid-pressure chamber of the fluid-pressure cylinder.

10. A method of controlling a die cushion device that includes 1) a fluid-pressure cylinder that supports a cushion pad, generates die cushion force while a slide of a press machine descends, and includes a rod side fluid-pressure chamber and a cap side fluid-pressure chamber, 2) a first fluid-pressure circuit that supplies pressure fluid to the cap side fluid-pressure chamber of the fluid-pressure cylinder, and 3) a second fluid-pressure circuit that enables operation fluid to be prevented from flowing out from a rod side fluid-pressure chamber of the fluid-pressure cylinder, or that enables the operation fluid to flow into the rod side fluid-pressure chamber, the method comprising the steps of:

starting die cushion force control when the slide descends and reaches a position at which the slide collides with the cushion pad;

preventing, before starting die cushion force control, the operation fluid from flowing out from the rod side fluid-pressure chamber of the fluid-pressure cylinder by controlling the second fluid-pressure circuit; and pressurizing, before starting die cushion force control, the cap side fluid-pressure chamber of the fluid-pressure cylinder by controlling the first fluid-pressure circuit to supply pressure fluid to the cap side fluid-pressure chamber of the fluid-pressure cylinder while controlling the first fluid-pressure circuit prevents the operation fluid from flowing out from the rod side fluid-pressure chamber.

11. The method of controlling the die cushion device, according to claim 10, further comprising the step of supplying, after the die cushion force control is completed, the operation fluid to the cap side fluid-pressure chamber of the fluid-pressure cylinder by controlling the first fluid-pressure circuit to raise the cushion pad to a die cushion standby position; and restarting the die cushion force control when the slide descends and reaches the position at which the slide collides with the cushion pad, wherein after the cushion pad is raised to the die cushion standby position and before re-starting the die cushion force control, the step of preventing the operation fluid from flowing out is repeated.

12. The method of controlling the die cushion device, according to claim 10, wherein pressure in the cap side fluid-pressure chamber during the step of pressurizing is equal to pressure in the cap side fluid-pressure chamber when the fluid-pressure cylinder generates a preset die cushion force.

13. The method of controlling the die cushion device, according to claim 11, wherein pressure in the cap side fluid-pressure chamber during the step of pressurizing is more than pressure in the cap side fluid-pressure chamber when the cushion pad is raised to the die cushion standby position, the pressure in the cap side fluid-pressure chamber during the step of pressuring is less than pressure in the cap side fluid-pressure chamber when the fluid-pressure cylinder generates a preset cushion force.

14. The method of controlling the die cushion device, according to claim 10, wherein the die cushion device further includes a die cushion position controller configured to allow, after the cushion force control completes, the operation fluid to be supplied to the cap side fluid-pressure chamber of the fluid-pressure cylinder by controlling the first fluid-pressure to raise the cushion pad to a predetermined die cushion standby position, and the method includes the step of controlling the second fluid-pressure circuit during press forming performed by lowering the slide and during position control of the cushion pad to enable the operation fluid to flow into the rod side fluid-pressure chamber of the fluid-pressure cylinder during the press forming as well as enable the operation fluid to flow out from the rod side fluid-pressure chamber of the fluid-pressure cylinder during the position control.

15. A method of controlling a die cushion device that includes a fluid-pressure cylinder that supports a cushion pad, generates die cushion force while a slide of a press machine descends, and includes a rod side fluid-pressure chamber and a cap side fluid-pressure chamber, the method comprising the steps of:

supplying operation fluid to the cap side fluid-pressure chamber of the fluid-pressure cylinder to rise the cushion pad and move the cushion pad to a preset die cushion standby position;

starting die cushion force control when the slide descends and reaches a position at which the slide collides with the cushion pad;

preventing, after setting the cushion pad at the die cushion standby position and before descending the slide to collide with the cushion pad, the operation fluid from flowing out from the rod side fluid-pressure chamber of the fluid-pressure cylinder; and pressurizing, after setting the cushion pad at the die cushion standby position and before descending the slide to collide with the cushion pad, the cap side fluid-pressure chamber of the fluid-pressure cylinder by supplying pressure fluid to the cap side fluid-pressure chamber of the fluid-pressure cylinder while preventing the operation fluid from flowing out from the rod side fluid-pressure chamber.

* * * * *